US006148960A

United States Patent [19]

Fraser

[11] Patent Number: 6,148,960

[45] Date of Patent: Nov. 21, 2000

[54] CHECKOUT COUNTER DIVIDER BAR TRACKS

[76] Inventor: William Alexander Fraser, 3001 Audubon Ter., NW., Washington, D.C. 20008

[21] Appl. No.: 09/101,794

[22] PCT Filed: Jul. 5, 1996

[86] PCT No.: PCT/US96/11742

§ 371 Date: Jul. 22, 1998

§ 102(e) Date: Jul. 22, 1998

[87] PCT Pub. No.: WO98/02070

PCT Pub. Date: Jan. 22, 1998

[51] Int. Cl.[7] ..... A47F 9/04; G09F 3/18

[52] U.S. Cl. ..... 186/68; 312/140.4

[58] Field of Search ..... 186/52, 59, 68, 186/69; 40/140.4

[56] References Cited

U.S. PATENT DOCUMENTS

| | | | |
|---|---|---|---|
| 2,090,057 | 8/1937 | Maddox | 312/140.4 |
| 4,534,126 | 8/1985 | Gilman . | |
| 5,272,826 | 12/1993 | Gingras | 40/642 |
| 5,450,926 | 9/1995 | Fraser | 186/59 |
| 5,620,061 | 4/1997 | Fraser | 186/68 |

*Primary Examiner*—F. J. Bartuska
*Attorney, Agent, or Firm*—Papan Devnani, Esq.; C. C. Shroff

[57] ABSTRACT

A track (2) for storing divider bars (24) used on a checkout counter (12) having a conveyor (14). The track (2) can be fitted over or replace a previously-installed track (10), and can store display/divider bars of much greater width than those presently in use. The wider surfaces of the new track also provide areas on which advertising can be displayed. The new tracks can be secured in place temporarily for ease of replacement by tracks displaying or holding updated advertising information.

23 Claims, 3 Drawing Sheets

CHECKOUT COUNTER DIVIDER BAR TRACKS

This application relates to U.S. provisional patent application Nos. 60/003,048, filed Aug. 31, 1995, and 60/008,628, filed Dec. 12, 1995.

BACKGROUND OF THE INVENTION

1. Field of the Invention

The present invention relates to apparatus and methods for handling items for purchase from a store having a checkout counter. More specifically, the present invention relates to tracks for storing divider bars used to separate consumer purchases awaiting checkout. The tracks can be fitted to conveyor-type market checkout counters to accommodate various types of checkout divider bars.

2. Description of the Related Art

Many shopping stores, such as supermarkets, utilize checkout counters having conveyors. The conveyor transports the items each customer has selected for purchase from a receiving end of the conveyor toward a cash register station. Typically, the conveyor is a belt, usually made from rubberized fabric. Usually several customers can place their selected orders on the conveyor at one time.

In order to prevent intermingling of goods between customers' orders, divider bars are provided that can be placed after each customer's group of items on the conveyor. The divider bars are often made of molded plastic, and may have advertisements or other printed information displayed on them. During periods of non-use, the divider bars are usually stored in a smooth track alongside the conveyor.

As the goods move along with the conveyor and are checked through the cash register station, each divider bar in turn reaches the cashier. The cashier generally returns the divider bar to the track running alongside the conveyor. The divider bars slide along the track, usually as a result of being pushed by other divider bars, so that each divider bar eventually returns to the receiving end of the conveyor to await use by another customer.

Pursuant to applicant's U.S. Pat. No. 5,450,926, the entire disclosure of which is incorporated herein by reference, a divider bar is provided that carries and displays merchandise to be purchased. The patented display/divider bar can be filled with items such as candy, gum, novelty items, etc. The display/divider bar, and/or its contents, can be purchased along with the customer's other goods. The display/divider bar advantageously is larger than conventional divider bars presently in use, and does not fit in the storage tracks currently being used.

As a result, the need exists for a track that can be installed on conveyor checkout counters and that can accommodate the new display/divider bars. Further, the need exists for wider tracks that can be fitted to existing, conventional checkout counters without the need for removing the previously-installed, conventional tracks. In addition, the need exists for a storage track having advertising display carriers and wider surfaces that can be used for the effective presentation of advertising material.

SUMMARY OF THE INVENTION

The present invention overcomes the disadvantages of the prior art noted above by providing a storage track that can accommodate a larger display/divider bar. The track can be incorporated as part of a newly-installed checkout counter. Alternatively, the track fits readily on an existing, conventional checkout counter, either by removing a previously-installed track and replacing it with the track of the present invention, or by installing the track of the present invention over the previously-installed track.

Advantageously, the visible surfaces of the divider bar track can be used for displaying advertisements at the checkout counter. Accordingly, the track includes attachments for securing advertising displays to the divider bar track, either permanently or, according to a preferred embodiment, temporarily.

A fixture is also included for installation of the track on the checkout counter. Track installation also can be permanent or temporary. According to a preferred embodiment, installation of the track is temporary. The track is interchangeable with a similar track previously installed on the checkout counter, so that advertising displays can be updated or changed, as discussed more fully below in conjunction with a preferred method of advertising according to the present invention.

According to another preferred embodiment, the track of the present invention includes a bottom panel having a width, a front edge and a rear edge, a rear wall adjoining the bottom panel on the rear edge, and a front wall adjoining the bottom panel on the front edge. The track further includes a fixture for securing the track to a surface. In one embodiment, the track is secured permanently, using screws, for example. Alternatively, the track can be secured more temporarily, using hook-and-loop fasteners, for example. By temporarily securing the track, easy removal is made possible for cleaning, or for substitution of the track with another, for the purpose of updating advertising displays, for example.

In a preferred embodiment, the track has a notch running lengthwise along the bottom panel that fits over the wall of a previously-installed, conventional track. The notch divides the present invention lengthwise into two tracks, a smaller track that fits into the previously-installed, conventional narrow track, and a wider track. The wider track accommodates the applicant's patented display/divider bars, and typically extends over the conveyor. Preferably, the portion of the bottom panel accommodates the wider display/divider bars so that they rest flat in the track. For example, the track can be at least three inches in width.

The present invention also provides a method of fitting a divider bar track onto a checkout counter having a conveyor with a conventional, previously-installed track. The method includes the step of installing a track for a checkout counter display/divider bar over a previously-installed track. The track is secured to the checkout counter, either temporarily or permanently, preferably by fasteners attached, for example, to a rear wall adjoining the bottom panel on the rear edge.

The present invention also includes a method of displaying advertisements at a checkout counter. The method includes attaching an advertising display on a divider bar track, and installing the track on the checkout counter. Installing the track comprises interchanging the track with a previously-installed track of the present invention.

Other features and advantages of the present invention will become apparent from the following description of the invention which refers to the accompanying drawings.

DETAILED DESCRIPTION OF THE PREFERRED EMBODIMENTS

Figure 1:
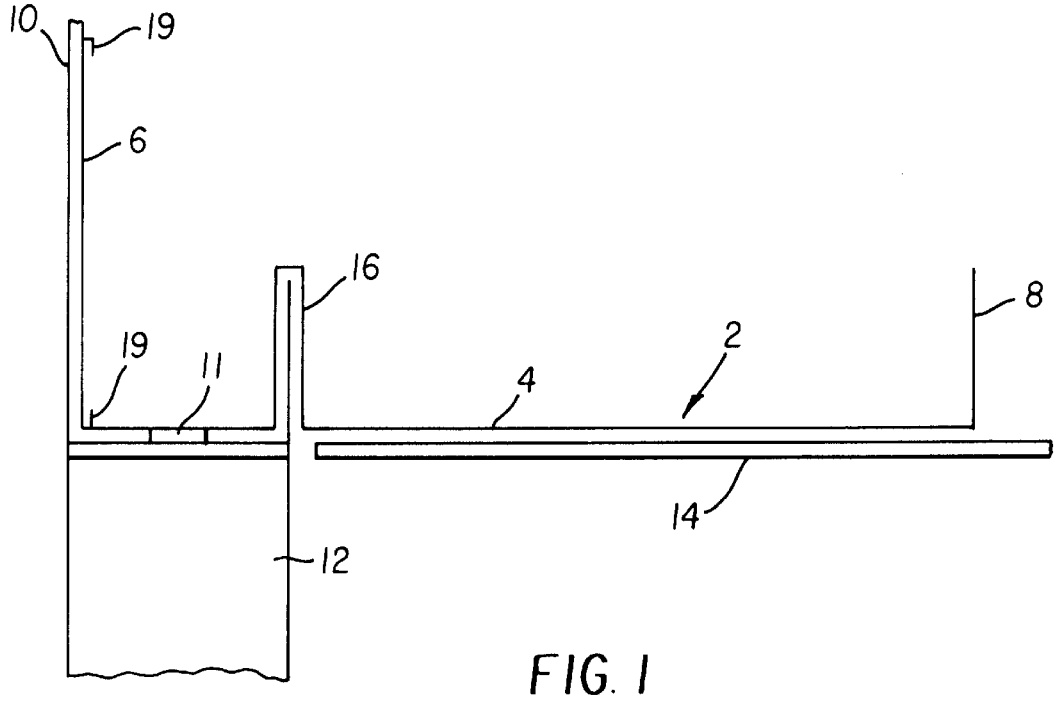
FIG. 1 shows an end view schematic of a divider bar track according to a preferred embodiment of the present invention.
Figure 2:
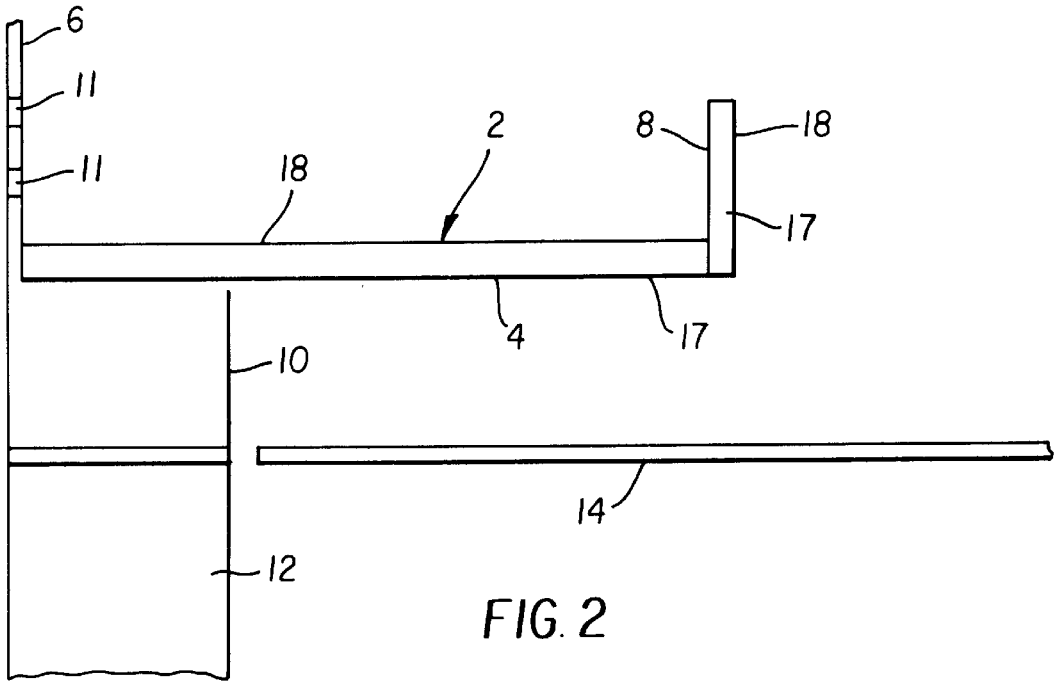
FIG. 2 shows an end view schematic of a divider bar track according to an alternative preferred embodiment of the present invention.

Referring first to FIGS. 1 and 2, end views of divider bar tracks 2 according to the present invention are shown. The track includes a bottom panel 4, a rear wall 6 joined perpendicularly to the bottom panel toward its rear edge, and a front wall 8 joined perpendicularly to the bottom panel on the front edge thereof.

The tracks 2 of the present invention are shown installed over a previously-installed, conventional track 10. The conventional track 10 is secured to counter 12, adjacent conveyor belt 14, shown in schematic cross-section. Alternatively, the tracks can be installed so as to replace the conventional track, as discussed below.

According to the embodiment shown in FIG. 1, the track 2 of the present invention includes a notch 16 that fits over the front wall of previously-installed, conventional track 10. Accordingly, bottom panel 4 of track 2 is divided into two tracks, the narrower track accommodating the known divider bars, for example, and the wider track accommodating wide divider bars. As shown in FIG. 1, the bottom panel is suspended approximately ⅛" above conveyor 14.

Track 2 can be secured either permanently or temporarily to the checkout counter using attachments 11. Attachments 11 can be relatively permanent, such as screws, nails, bolts, plastic anchors, adhesive, or any other type of permanent fixation system. According to an alternative embodiment, attachments 11 are for temporary fixation. Illustrative temporary attachments include hook-and-loop fasteners, double-sided tape, snaps, clips, magnets, or a press-to-fit arrangement, for example.

Advantageously, when tracks 2 are attached temporarily, the tracks can be removed readily for replacement. In a particularly preferred embodiment, tracks 2 carry advertising information displayed on the various surfaces visible to the customer. The advertisement copy can be held by various means on the track, either permanent or temporary. Illustrative examples of attachments for the advertisements to the track include hook-and-loop fasteners, double-sided tape, snaps, clips, magnets, or press-to-fit arrangements. Preferably, the advertisements are held in slots 17 formed behind transparent panels. The transparent panels can be formed of plastic or glass, for example.

Accordingly, a transparent panel is positioned to create a slot in which an advertising display can be positioned. For example, referring to FIG. 2, above bottom panel 4 transparent panel 18 is positioned to protect the advertisement and to allow the customer to read the advertisement held in slot 17. Similarly, the outer side of wall 8 is covered with another panel 18. Alternatively, the advertisement display carrier could take the form of paired notches 19 in which the advertisements are positioned and held for display. See FIGS. 1 and 2.

These advertisements can be sold on a cyclical basis, for example, for four-week periods. The temporarily-installed tracks are then readily detached and replaced at the end of each advertising cycle with a fresh set of displays having new advertisements held thereon. Alternatively, the tracks could remain in place permanently, and the advertising could be replaced.

The tracks of the present invention typically are made of metal. According to a preferred embodiment, a transparent panel is disposed above a visible surface of the track so as to create a protected space into which an advertisement can be inserted. Alternatively, the track can be made of a transparent material such as plastic, or a combination of metal and plastic, or other materials having sufficient durability.

Advertisements can printed on various materials such as paper or plastic. Where the advertisement may be exposed to damage, such as by moving divider bars, groceries, or customers, a material that will not be effected by such exposure is used.

Figure 3:
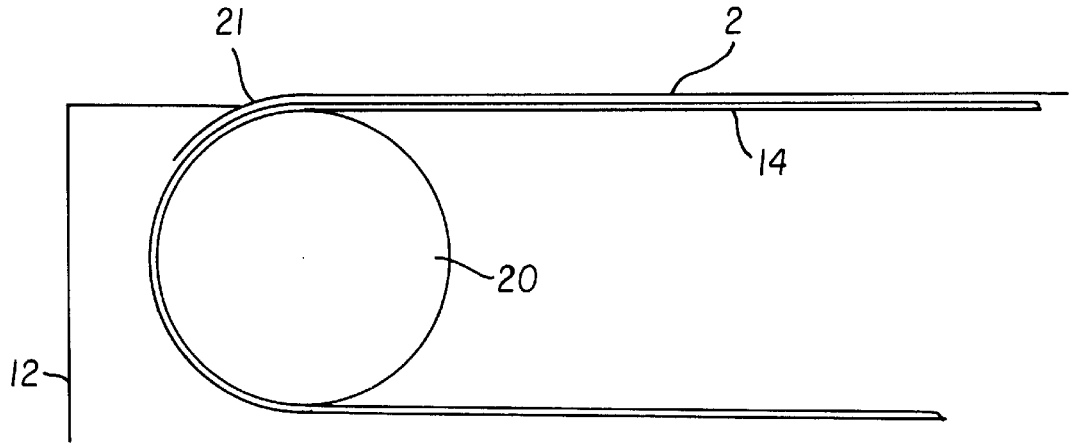
FIG. 3 shows a schematic side view of a divider bar track according to a preferred embodiment of the present invention.
Figure 4:
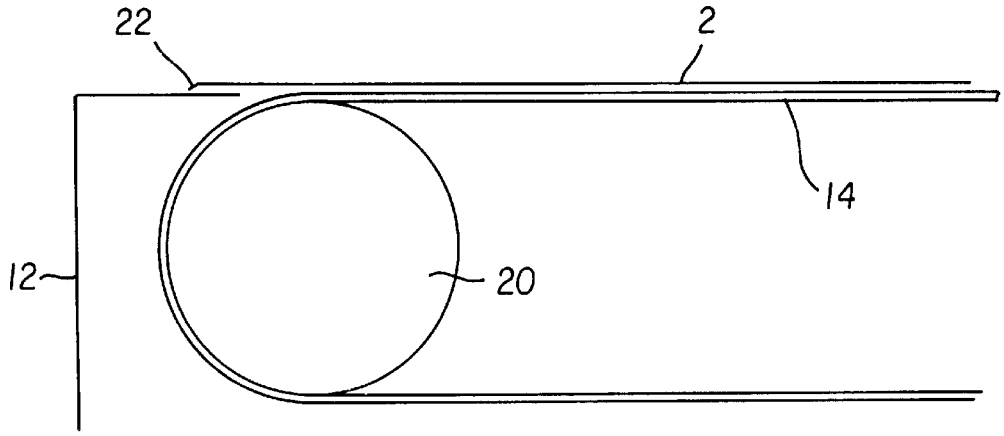
FIG. 4 shows a schematic side view of a divider bar track according an alternative preferred embodiment of the present invention.

Referring to FIGS. 3 and 4, tracks 2 are shown schematically from the side, having been installed on a counter 12 above conveyor 14 which is driven by rollers 20. In order to prevent items from becoming lodged between conveyor 14 and track 2, or between track 2 and the edge of counter 12, a guard 21 is provided as shown in FIG. 3. Guard 21 extends under the edge of counter 12 and above conveyor 14 to prevent items from becoming trapped.

A similar type of guard is shown in FIG. 4. Guard 22 is shown extending above and beyond the edge of counter 12. Guards 21, 22 can be formed as an integral extensions of track 2, or as separately-attached pieces.

Figure 5:
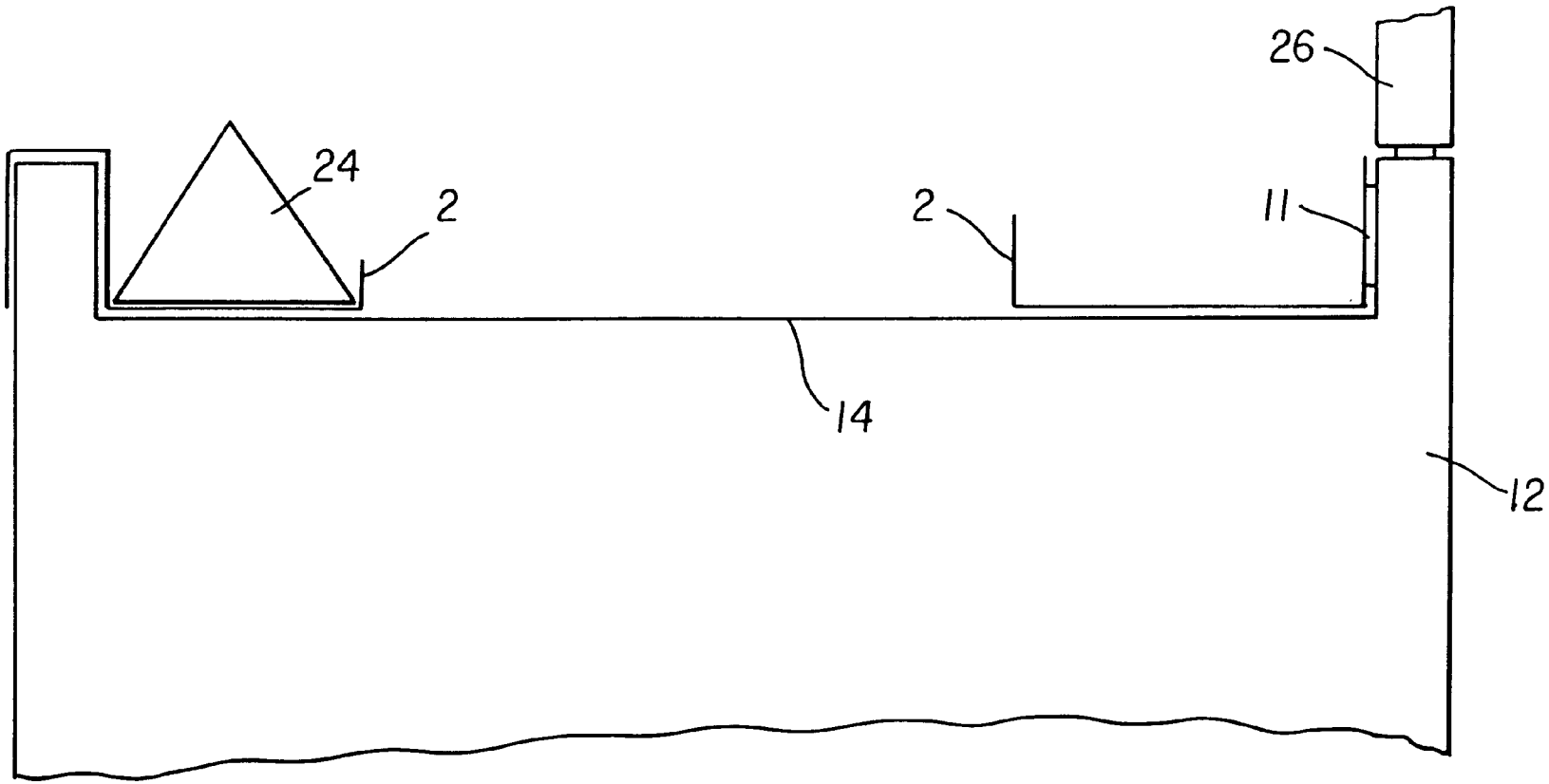
FIG. 5 is an end view of a checkout counter showing the placement of divider bar tracks according to a preferred embodiment of the present invention.

Referring to FIG. 5, the track of the present invention, shown schematically, is installed on either side of the conveyor. The end view is shown of a display divider 24 stored in one of the tracks 2. As shown, tracks can be installed on both sides of the conveyor, to provide increased visibility both of advertisements provided on the tracks and of divider bars containing purchasable merchandise stored in the tracks.

FIG. 5 also illustrates the tracks of the present invention installed directly onto counter 12 above conveyor belt 14 (shown schematically). If desired, previously-installed track 26 can remain in place for storage of conventional divider bars. The installation can be permanent or temporary, using various fasteners 11, as noted above.

Although the present invention has been described in relation to particular embodiments thereof, many other variations and modifications and other uses will become apparent to those skilled in the art. Therefore, the present invention is to be limited not by the specific disclosure herein, but only by the appended claims.

What is claimed is:

1. A track for displaying advertisements at a checkout counter, the track comprising:

a divider bar track;

an attachment on the divider bar track for temporarily holding an advertisement display on the divider bar track; and a fixture on the divider bar track for installation of the track on the checkout counter.

2. The track of claim 1, wherein the track is interchangeable with a previously-installed track secured on the checkout counter.

3. The track of claim 1, wherein the previously-installed track is secured temporarily.

4. The track of claim 1, wherein the track is adapted to be installed over a previously-installed track secured on the checkout counter.

5. A track for storing at least one divider bar for use on a checkout counter having a conveyor and a previously installed divider bar track having a first width, the track comprising:

a bottom panel having a second width greater than the first width, a front edge, and a rear edge;

a rear wall adjoining the bottom panel on the rear edge;

a front wall adjoining the bottom panel on the front edge; and members for holding advertisements displayed on the track.

6. The track of claim 5, further comprising a fixture for securing the track to a surface.

7. The track of claim 6, wherein the fixture secures the track to the surface permanently.

8. The track of claim 5, wherein the bottom panel includes a notch for receiving a wall of a previously-installed track.

9. The track of claim 5, wherein said members for holding advertisements are selected from the group consisting of hook-and-loop fasteners, double-sided tape, snaps, clips, magnets, and press-to-fit arrangements.

10. The track of claim 5, further comprising a divider bar.

11. A checkout counter having a conveyor and a previously-installed track for storing divider bars, the previously-installed track having a bottom panel having width, the checkout counter further comprising:

a track for a checkout counter divider bar fitted over the previously-installed track and having a bottom panel with a width greater than the width of the bottom panel of the previously-installed track, a front edge and a rear edge;

a rear wall adjoining the bottom panel on the rear edge; and a front wall adjoining the bottom panel on the front edge.

12. The checkout counter of claim 11, further comprising fixtures for securing the track to a surface.

13. The checkout counter of claim 12, wherein the fixtures secure the track to the surface permanently.

14. The checkout counter of claim 11, wherein the bottom panel includes a notch for receiving a wall of a previously-installed track in the notch.

15. The checkout counter of claim 11, wherein the track includes attachments for holding an advertising display on the track.

16. A method of fitting a new track on a checkout counter having a conveyor and a previously-installed track for storing divider bars, the previously-installed track having a bottom panel having a width, the method comprising the steps of:

installing a track for a checkout counter divider bar over the previously-installed track, the track having a bottom panel with a width greater than the width of the bottom panel of the previously-installed track, a front edge and a rear edge; and securing the track to the checkout counter.

17. The method of claim 16, wherein the track comprises a rear wall adjoining the bottom panel on the rear edge; and a front wall adjoining the bottom panel on the front edge.

18. The method of claim 16, wherein the step of securing the track to a surface is performed using a permanent securement.

19. The method of claim 16, wherein the bottom panel includes a notch for receiving a wall of a previously-installed track, and the step of installing includes installing the track over the wall of the previously-installed track.

20. The method of claim 16, further comprising the step of positioning advertising on the track.

21. A method of displaying advertisements at a checkout counter, the method comprising:

positioning an advertising display on a divider bar track; and installing the track with the advertising positioned thereon on the checkout counter.

22. The method of claim 21, wherein the step of installing the track comprises interchanging the track with a previously-installed track secured to the checkout counter.

23. The method of claim 22, wherein the step of installing the track comprises securing the track over a previously-installed track permanently secured to the checkout counter.

* * * * *